US007732722B1

(12) United States Patent
Singh et al.

(10) Patent No.: US 7,732,722 B1
(45) Date of Patent: Jun. 8, 2010

(54) HERMETICALLY SEALED PRESSURE SWITCH WITH COMPOSITE ACTUATION MECHANISM

(75) Inventors: Aparajita Singh, Bangalore (IN); Bharath Mahalingam, Bangalore (IN); Vijayshekhar Araganji, Bangalore (IN); Kevin Haf, Charlevoix, MI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/391,418

(22) Filed: Feb. 24, 2009

(51) Int. Cl.
*H01H 35/24* (2006.01)

(52) U.S. Cl. ..... 200/82 R; 200/83 R; 200/83 J

(58) Field of Classification Search ..... 200/82 R, 200/82 B, 82 C, 82 A, 83 R, 83 J, 83 Q, 83 S, 200/83 SA
See application file for complete search history.

(56) References Cited

U.S. PATENT DOCUMENTS

| | | | | | |
|---|---|---|---|---|---|
| 3,042,771 | A | | 7/1962 | Oliveau | 200/83 |
| 3,246,093 | A | | 4/1966 | Boettinger | 200/83 |
| 3,335,244 | A | | 8/1967 | Mejean et al. | 200/140 |
| 3,742,165 | A | * | 6/1973 | Hellman | 200/83 Y |
| 3,861,277 | A | * | 1/1975 | Wagner et al. | 92/34 |
| 4,215,254 | A | * | 7/1980 | Ohki | 200/83 C |
| 4,237,354 | A | | 12/1980 | Rockenfeller et al. | 200/83 C |
| 4,254,312 | A | | 3/1981 | Migrin et al. | 200/61.25 |
| 4,272,959 | A | * | 6/1981 | Yamane | 60/602 |
| 4,346,272 | A | * | 8/1982 | Stoll | 200/83 C |
| 4,392,034 | A | * | 7/1983 | Payne | 200/81.4 |
| 4,605,832 | A | | 8/1986 | Koopmann | 200/83 D |
| 4,616,114 | A | | 10/1986 | Strasser | 200/83 J |
| 4,633,579 | A | | 1/1987 | Strasser | 29/622 |
| 4,647,739 | A | * | 3/1987 | Boulet | 200/81.4 |
| 4,900,883 | A | * | 2/1990 | Brame et al. | 200/83 S |
| 4,980,675 | A | * | 12/1990 | Meisenheimer, Jr. | 340/626 |
| 5,004,873 | A | * | 4/1991 | Schnut | 200/83 P |
| 5,626,222 | A | | 5/1997 | Aguilera | 200/305 |
| 6,194,678 | B1 | | 2/2001 | Yoshikawa et al. | 200/512 |
| 2004/0222076 | A1 | | 11/2004 | Webb et al. | 200/512 |

FOREIGN PATENT DOCUMENTS

| | | | |
|---|---|---|---|
| EP | 1975417 | A1 | 10/2008 |
| WO | WO03/100262 | A1 | 12/2003 |
| WO | WO2007083471 | A1 | 7/2007 |

* cited by examiner

*Primary Examiner*—Michael A Friedhofer
(74) *Attorney, Agent, or Firm*—Ingrassia Fisher & Lorenz, P.C.

(57) ABSTRACT

A hermetically sealed pressure switch apparatus and method includes a metal bellows directly installed at an inlet port for providing hermetic sealing thereof. A spring (e.g. a wave spring) can be connected in parallel or series combination with the metal bellows. The metal bellows is capable of being extended when an input pressure is applied which in turn compress the wave spring. The compression of the spring transfers a required motion to a plunger associated with an electrical switch in order to actuate the electrical switch when a certain pressure relative to a perfect vacuum is attained. The metal bellows and the spring can be pre-compressed utilizing the plunger in order to maintain switch set point accuracy and spring stiffness.

19 Claims, 3 Drawing Sheets

HERMETICALLY SEALED PRESSURE SWITCH WITH COMPOSITE ACTUATION MECHANISM

TECHNICAL HELD

Embodiments are generally related to pressure sensitive electrical switching devices and methods. Embodiments are also related to absolute pressure switches utilized in the context of pressure sensing applications. Embodiments are additionally related to the actuation of absolute pressure switches.

BACKGROUND OF THE INVENTION

In general, switches are utilized to switch devices from an open/off position to a closed/on position in order to control the operation of particular devices and/or systems. Pressure switches are widely utilized for controlling electrically operated devices by switching an electrical contact between open and closed circuit positions based on a preset fluid pressure threshold. Pressure switches provide a reliable indication of a fault indicative pressure while simultaneously obviating switch actuation caused by excess pressures. Such pressure-sensitive switches can be utilized in a wide variety of applications such as, for example, fuel, hydraulic, potable water, and engine oil pressure systems.

An absolute pressure switch essentially needs to maintain vacuum inside the pressure switch for precise measurement of a media such as a liquid or gas flowing through a system. Such absolute pressure switches can be utilized in aerospace applications in order to effectively regulate pressure relative to the aircraft system requirements. The majority of prior art absolute pressure switches are typically configured with an elastomeric diaphragm that is impinged upon by the media under pressure. The diaphragm may actuate the switch contacts of the pressure switch upon reaching a predetermined pressure. Such pressure switches, however, tend to operate only at relatively low pressure levels and are not sufficiently miniaturized, since they frequently occupy more space.

The elastomeric diaphragm may be affected by surrounding dust, which tends to damage the diaphragm, particularly when it is not properly sealed. Additionally, in harsh conditions (e.g., extreme temperatures) such diaphragms may stiffen at cold conditions, thereby leading to a change in a predetermined set point. Furthermore, these types of elastomeric diaphragms tend to breathe over a period of time, which induces drift in the set point.

Note that other types of conventional pressure switches may include the use of a push member, two contact points, a spring member and an enclosure, which receives all the parts therein. Such a pressure switch may improve the switching operation, but increases its overall size and manufacturing costs.

Based on the foregoing, it is believed that a need exists for a low cost, absolute pressure switch apparatus for providing hermetic sealing and maintaining switch set point accuracy at high and low temperature ranges. It is also believed that a need exists for an improved switch actuation mechanism, as described in greater detail herein.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved hermetically sealed absolute pressure switch apparatus and method.

It is another aspect of the present invention to provide for an improved method for actuating the pressure switch apparatus and method.

The aforementioned aspects and other objectives and advantages can now be achieved as described herein. A hermetically sealed pressure switch apparatus is disclosed, which includes a metal bellows (e.g., nickel) directly installed at an inlet port for providing hermetic sealing. A spring such as, for example, a wave spring, can be connected in parallel (or series) combination with the metal bellows. It can be appreciated, of course, that other types of springs may be utilized in place of the suggested wave spring and can be arranged in series (rather than parallel) depending upon design considerations.

The metal bellows is capable of being extended when an input pressure is applied which in turn compress the spring. The compression of the spring transfers a required motion to a plunger associated with an electrical switch in order to actuate the electrical switch when a certain pressure relative to a perfect vacuum is attained. The metal bellows and the spring can be pre-compressed utilizing the plunger thereby providing stability in vibration conditions and spring stiffness. The tolerances of the plunger dimensions can be controlled in order to achieve a maximum and minimum pre-compression of the metal bellows.

The electrical switch can be actuated utilizing the plunger loaded by the spring and the metal bellows. The metal bellows and the spring operate as parallel springs thereby providing same deflection with more loads and with combined spring constants. The plunger rests on the entry port due to the load of the adjustable preset spring. The spring can be tuned to provide deflection required for the electrical switch to actuate. The bellows and the spring can be pre-compressed in order to adjust the required factory set point. The wall of the metal bellows can be very thin and are extremely sensitive for very accurate instrument applications requiring high degree of sensitivity. The metal bellows are seamless and non-porous and provide hermetic sealing with a leakage rate of about 10e-09 cc-helium/sec.

The compact springs save space and provide more precise load deflection characteristics. The metal bellows provide hermeticity with dynamic sealing application and acts as a collapsible seal, whereas the spring takes higher percentage of applied load thereby providing compact size and set point accuracy. The metal bellows and springs prevent dust, dirt, or moisture from entering the switch apparatus. The absolute switch apparatus are hermetically sealed for life and can withstand shock, vibration, and temperature cycling. The switch apparatus possesses the ability to set switch differentials and can withstand high proof and burst pressures. Such absolute pressure switch apparatus can be utilized in aerospace applications thereby providing effective sealing and maintaining switch set point accuracy at high and low temperature ranges.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
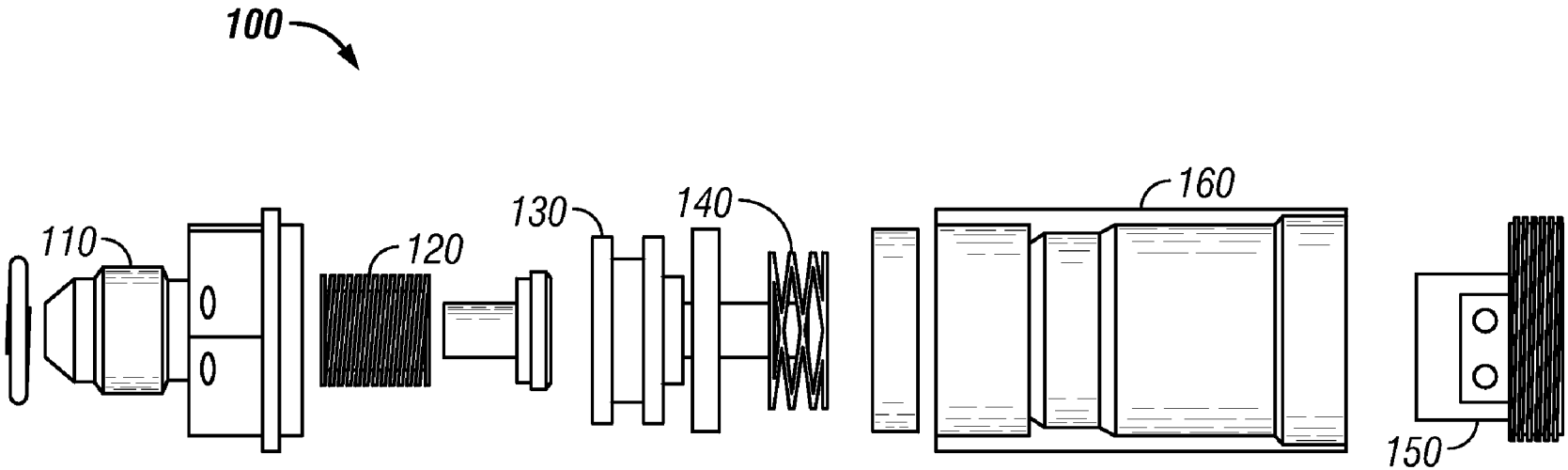
FIG. 1 illustrates an exploded view of a hermetically sealed absolute pressure switch apparatus, in accordance with a preferred embodiment.

FIG. 1 illustrates an exploded view of a hermetically sealed absolute pressure switch apparatus 100 that changes the electrical output state based on the pressure of a fluid, in accordance with a preferred embodiment. The pressure switch apparatus 100 depicted in FIG. 1 generally includes an inlet port 110 configured to be connected in fluid communication with a fluid such as, for example, a liquid or a gas. The hermetically sealed pressure switch apparatus 100 can be utilized in a wide variety of applications such as, for example, fuel, hydraulic, potable water, and engine oil pressure systems requiring discrete measure. It can be appreciated that the disclosed absolute pressure switch apparatus 100 can also be utilized in aerospace applications for improved accuracy and repeatability The absolute pressure switch apparatus 100 generally includes a metal bellows 120 directly installed at the inlet port 110 of the switch apparatus 100 for providing hermetic sealing. Metal bellows 120 can be configured as cylindrical vessels that are capable of being compressed when pressure is used on the top or the bottom of the vessel (or both). When the pressure is removed, the bellows can return back to its original shape (provided the material has not been 'pushed' past its yield strength). The metal bellows 120 provide hermeticity with dynamic sealing application and functions as a collapsible seal. The wall of the bellows 120 can be very thin and extremely sensitive for very accurate instrument applications requiring high degree of sensitivity. The absolute pressure switch apparatus 100 further includes a housing 160 comprising a spring 140, a plunger 130, and an electrical switch 150 that actuates by means of a composite actuation mechanism provided by the metal bellows 120 and the spring 140. Note that the spring 140 can be provided in the form of, for example, a wave spring or another appropriate spring component, depending upon design considerations.

The metal bellows 120 and the spring 140 can be utilized as the actuation mechanism for the electrical switch 150. The spring 140 can be connected in parallel (or series) combination with the metal bellows 120. The plunger 130 rests on the inlet port 110 due to the load of the adjustable preset spring 140. The metal bellows 120 described herein can be joined with the inlet port 110 by a number of processes such as, for example, brazing, soldering, and welding. It can be appreciated, of course, that other types of processes may be utilized in place of the suggested processes, depending upon design considerations. As indicated earlier, It can be appreciated, of course, that other types of springs may be utilized in place of the suggested wave spring and can be arranged in series (rather than parallel) depending upon design considerations. The discussion of a parallel arrangement, as discussed herein, merely refers to a preferred embodiment, but a series arrangement can be implemented as well or in lieu of the parallel configuration.

The electrical switch 150 can be secured to the housing 160 to activate the electrical switch 150 in response to the movement of the plunger 130. The type of electrical switch utilized herein is a normally closed switch. However, it will be apparent to those of skill in the art that other type of switches can be utilized as desired without departing from the scope of the invention. The spring 140 transfers a required motion to the plunger 130 associated with the electrical switch 150 in order to actuate the electrical switch 150. The adjustment of the spring force of the spring 140 by extending or releasing spring length thereof changes the necessary force to move the plunger 130 and activate the electrical switch 150. The change in force of the spring 140 changes or alters the pressure necessary to operate the electrical switch 150.

Figure 2:
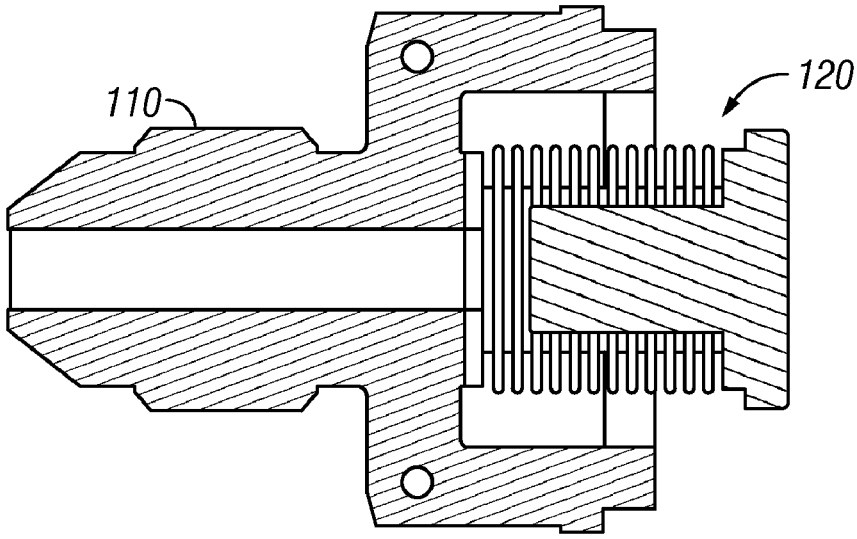
FIG. 2 illustrates a perspective view of metal bellows associated with the absolute pressure switch apparatus, in accordance with a preferred embodiment.

FIG. 2 illustrates a perspective view of the metal bellows 120 associated with the absolute pressure switch apparatus 100, in accordance with a preferred embodiment. Note that in FIGS. 1-4, identical or similar blocks are generally indicated by identical reference numerals. The metal bellows 120 are seamless and non-porous and provide hermetic sealing with a leakage rate of about 10e-09 cc-helium/sec. The miniature bellows 120 are extremely sensitive and provide large deflections with minute forces depending upon the spring rate for very accurate applications. The metal bellows 120 can be pre-compressed utilizing the plunger 130, thereby providing spring stiffness and stability to the switch apparatus 100 in vibration conditions.

The tolerances of the plunger 130 dimensions can be controlled to achieve the maximum and minimum pre-compression of the metal bellows 120. The metal bellows 120 can provide large deflections with only very minute forces. The metal bellows 120 described herein may be configured from a material such as, for example, nickel, depending upon design considerations. The nickel bellows are ideal at low temperatures (−423° F.) and are resistant to corrosion. Such nickel bellows does not oxidize in air and are not affected by alkalies. It can be appreciated that other types of materials may be utilized in place of the suggested material.

Figure 3:
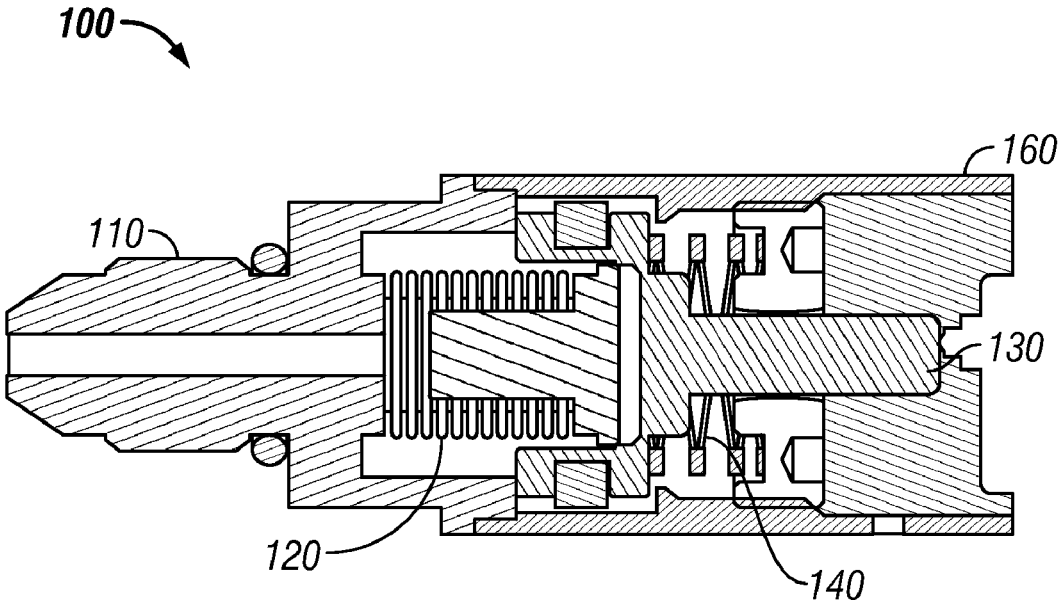
FIG. 3 illustrates a perspective view of the hermetically sealed absolute pressure switch apparatus, in accordance with a preferred embodiment.

FIG. 3 illustrates a perspective view of the absolute pressure switch apparatus 100, in accordance with a preferred embodiment. Note that the spring 140 can be tuned to provide deflection required for actuating the electrical switch 150. The metal bellows 120 and the spring 140 can operate as parallel springs (assuming a parallel arrangement rather than a series arrangement). The pressure switch apparatus 100 possess variable pre-compression of the spring 140 and is factory set for a certain set point. In general, the set point is as an exact pressure at which an electrical circuit controlled by the pressure switch changes contacts. The pressure switch may have a set point on either pressure rise or fall, but not both.

The spring 140 is capable of taking higher percentage of applied load thereby providing compact size and set point accuracy. The spring 140 takes required load and deflection with 50% less free height in comparison to normal compression springs. When an input pressure is applied, the metal bellows 120 is extended which in turn compress the spring 140. The spring 140 transfers a required motion to the plunger 130 associated with the electrical switch 150 in order to actuate the electrical switch 150 when a certain pressure relative to a perfect vacuum is attained. The electrical switch 150 can be actuated utilizing the plunger 130 loaded by the spring 140 and the metal bellows 120.

Note that the metal bellows 120 and the spring 140 can be pre-compressed to adjust the required factory set point. The compact spring 140 save space and provide more precise load deflection characteristics. The compactness of the switch apparatus 100 allows easy installation and accessibility in the mountings. The metal bellows 120 and the spring 140 prevent dust, dirt, or moisture from entering the apparatus. Note that the embodiments discussed herein should not be construed in any limited sense. It can be appreciated that such embodiments reveal details of the structure of a preferred form necessary for a better understanding of the invention and may be subject to change by skilled persons within the scope of the invention without departing from the concept thereof.

Figure 4:
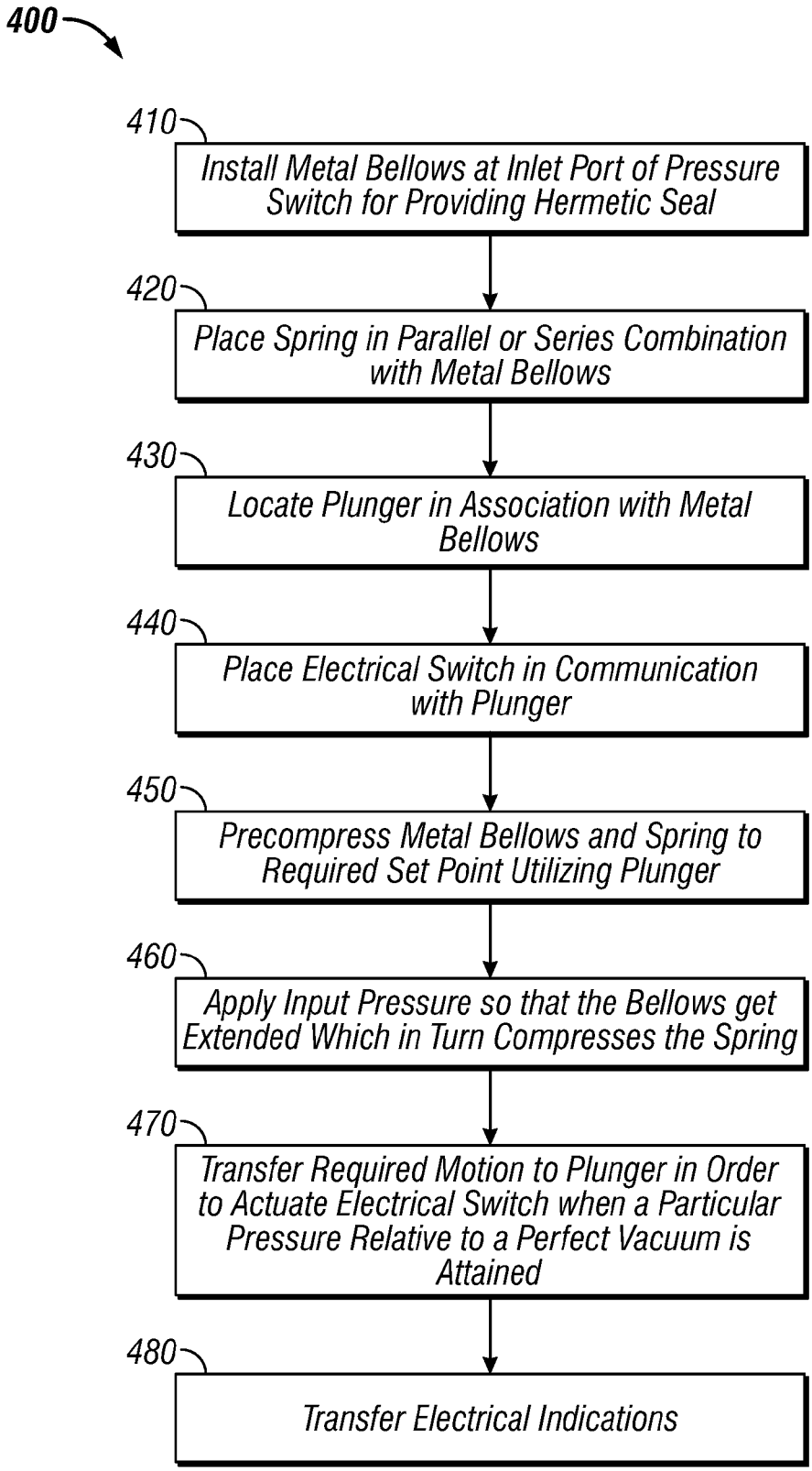
FIG. 4 illustrates a high level flow chart of operations illustrating logical operational steps of a method for actuating the hermetically sealed absolute pressure switch apparatus, in accordance with a preferred embodiment.

FIG. 4 illustrates a high level flow chart of operations illustrating logical operational steps of a method 400 for actuating the absolute pressure switch apparatus 100, in accordance with a preferred embodiment. The metal bellows 120 can be installed at the inlet port 110 of the pressure switch apparatus for providing hermetic seal, as indicated at block 410. Thereafter, as depicted at block 420, the spring 140 can be placed in parallel (or series) combination with the metal bellows 120. Note that the preferred embodiment discussed herein generally refers to a parallel arrangement, but it can be appreciated that a series arrangement can also be utilized depending on design considerations and goals. Next, as illustrated at block 430, the plunger 130 can be located in association with the metal bellows 120 and the spring 140. The electrical switch 150 can then be placed in communication with the plunger 130, as shown at block 440.

Next, as described at block 450, the metal bellows 120 and the spring 140 can be pre-compressed to a required set point utilizing the plunger 130. The input pressure can then be applied so that the metal bellows 120 is extended which in turn compresses the spring 140, as depicted at block 460. Thereafter, as shown at block 470, the required motion can be transferred to the plunger 130 in order to actuate the electrical switch 150 when a certain pressure relative to perfect vacuum is attained. The electrical indications can then be transferred, as illustrated at block 480. The metal bellows 120 maintains vacuum inside the pressure switch apparatus 100 throughout the lifetime of the switch apparatus 100 for precise measurement of the media. The switch apparatus 100 is capable of making an electrical contact when a certain pressure relative to perfect vacuum (0 PSI or no pressure) is attained on its input. The pressure switch apparatus 100 can be utilized in aircraft to effectively regulate pressure relative to aircraft system requirements.

Such pressure switch apparatus 100 is of compact size with ruggedness and durability. The absolute switch apparatus 100 is hermetically sealed for life and can withstand shock, vibration, and temperature cycling. The switch has the ability to set switch differentials and can withstand high proof and burst pressures. Such absolute pressure switch apparatus 100 can be utilized in jet engine controls, environmental controls, brake and hydraulic controls, potable water, fuel control, ammunition control, and bomb racks thereby providing effective sealing and maintaining switch set point accuracy at high and low temperature ranges.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A hermetically sealed pressure switch apparatus, said apparatus comprising:

a metal bellows installed at an inlet port, said metal bellows capable of being extended when an input pressure is applied, wherein said metal bellows provides a hermetic seal with respect to said hermetically sealed pressure switch apparatus;

a wave spring connected to said metal bellows, wherein said wave spring and said metal bellows are pre-compressed in order to maintain a switch set point accuracy and a spring stiffness thereof; and a plunger positionally responsive to said applied pressure and in communication with an electrical switch, wherein said wave spring compresses which in turn transfers a required motion to said plunger in order to actuate said electrical switch when a certain pressure relative to a perfect vacuum is attained, thereby maintaining a vacuum within said apparatus for precise measurement.

2. The apparatus of claim 1 wherein said wave spring is connected in parallel with said metal bellows, wherein said wave spring and said metal bellows operate as parallel springs with respect to one another.

3. The apparatus of claim 1 wherein said wave spring is connected in series with said metal bellows.

4. The apparatus of claim 1 wherein tolerances associated with said plunger are controllable in order to achieve a maximum pre-compression and a minimum pre-compression of said metal bellows.

5. The apparatus of claim 1 wherein said electrical switch is capable of being actuated by said plunger loaded by said wave spring and said metal bellows.

6. The apparatus of claim 1 wherein said applied pressure comprises an input pressure applicable so that said metal bellows is extended, which in turn compresses said wave spring.

7. The apparatus of claim 1 wherein said metal bellows is joined with said inlet port via a brazing process.

8. The apparatus of claim 1 wherein said metal bellows is joined with said inlet port via a soldering process.

9. The apparatus of claim 1 wherein said metal bellows is jointed with said inlet port via a welding process.

10. The apparatus of claim 1 wherein said metal bellows includes a collapsible seal that is seamless and non-porous in order to thereby provide said hermetic sealing.

11. The apparatus of claim 1 wherein said wave spring is tunable to provide a deflection required for said electrical switch to actuate.

12. A hermetically sealed pressure switch apparatus, said apparatus comprising:

a metal bellows installed at an inlet port, said metal bellows capable of being extended when an input pressure is applied, wherein said metal bellows provides a hermetic seal with respect to said hermetically sealed pressure switch apparatus;

a wave spring connected in parallel to said metal bellows, wherein said wave spring and said metal bellows operate as parallel springs and are pre-compressed in order to maintain a switch set point accuracy and a spring stiffness thereof; and a plunger positionally responsive to said applied pressure and in communication with an electrical switch, wherein said wave spring compresses which in turn transfers a required motion to said plunger in order to actuate said electrical switch when a certain pressure relative to a perfect vacuum is attained, thereby maintaining a vacuum within said apparatus for precise measurement.

13. A method of configuring a hermetically sealed pressure switch apparatus, said method comprising:

installing a metal bellows at an inlet port, said metal bellows capable of being extended when an input pressure is applied, wherein said metal bellows provides a hermetic seal with respect to said hermetically sealed pressure switch apparatus;

connecting a wave spring to said metal bellows, wherein said wave spring and said metal bellows are pre-compressed in order to maintain a switch set point accuracy and a spring stiffness thereof; and providing a plunger that is positionally responsive to said applied pressure and in communication with an electrical switch, wherein said wave spring compresses which in turn transfers a required motion to said plunger in order to actuate said electrical switch when a certain pressure relative to a perfect vacuum is attained, thereby maintaining a vacuum within said apparatus for precise measurement.

14. The method of claim 13 further comprising connecting said wave spring in parallel with said metal bellows, wherein said wave spring and said metal bellows operate as parallel springs with respect to one another.

15. The method of claim 13 further comprising connecting said wave spring in series with said metal bellows.

16. The method of claim 13 further comprising:

controlling tolerances associated with said plunger in order to achieve a maximum pre-compression and a minimum pre-compression of said metal bellows; and modifying said electrical switch such that said electrical switch is capable of being actuated by said plunger loaded by said wave spring and said metal bellows.

17. The method of claim 13 configuring said metal bellows to include a collapsible seal that is seamless and non-porous in order to thereby provide said hermetic sealing.

18. The method of claim 13 further comprising configuring said wave spring to be capable of handling a higher percentage of applied load in order to provide a compact size and said set point accuracy.

19. The method of claim 13 further comprising configuring said wave spring to be tunable to provide a deflection required for said electrical switch to actuate.

* * * * *